US006080952A

United States Patent [19]

Okutomi et al.

[11] Patent Number: 6,080,952

[45] Date of Patent: Jun. 27, 2000

[54] ELECTRODE ARRANGEMENT OF VACUUM CIRCUIT BREAKER WITH MAGNETIC MEMBER FOR LONGITUDINAL MAGNETIZATION

[75] Inventors: Tsutomu Okutomi; Tsuneyo Seki; Iwao Ohshima; Mitsutaka Homma; Hiromichi Somei; Kumi Uchiyama; Yoshimitsu Niwa; Kenji Watanabe, all of Tokyo, Japan

[73] Assignee: Kabushiki Kaisha Toshiba, Kawasaki, Japan

[21] Appl. No.: 09/210,804

[22] Filed: Dec. 15, 1998

[30] Foreign Application Priority Data

Dec. 16, 1997 [JP] Japan ..... P9-346066

[51] Int. Cl.[7] ..... H01H 33/66

[52] U.S. Cl. ..... 218/118; 218/123; 218/127

[58] Field of Search ..... 218/118, 120, 218/122, 123, 124, 125, 126, 127, 128, 129, 130

[56] References Cited

U.S. PATENT DOCUMENTS 4,928,017 5/1990 Aoki et al. ..... 200/144 B
5,438,174 8/1995 Slade ..... 218/118
5,691,521 11/1997 Komuro et al. ..... 218/123

FOREIGN PATENT DOCUMENTS 60-77327 5/1985 Japan .
4-92327 3/1992 Japan .

*Primary Examiner*—Lincoln Donovan
*Attorney, Agent, or Firm*—Oblon, Spivak, McClelland, Maier & Neustadt, P.C.

[57] ABSTRACT

An electrode arrangement of a vacuum circuit breaker for making and breaking electrical connection. The electrode arrangement has: a pair of contact members which are adopted for making contact to and release from each other by relatively moving to and from each other along a predetermined direction; a pair of electrically conductive bars being connected to the above pair of contact members, respectively, for providing electric conduction to the contact members; and a magnetizing device with a magnetic body for generating magnetic field parallel to the predetermined direction between the contact members. The magnetic body is composed of an iron alloy comprising 0.02 to 1.5% by weight of carbon and iron. The iron alloy may further contain at least one of manganese and silicon.

13 Claims, 5 Drawing Sheets

ELECTRODE ARRANGEMENT OF VACUUM CIRCUIT BREAKER WITH MAGNETIC MEMBER FOR LONGITUDINAL MAGNETIZATION

BACKGROUND OF THE INVENTION

1. Field of the Invention

The present invention relates to an electrode arrangement of a vacuum circuit breaker having improved breaking characteristics, and in particular to an electrode arrangement of a vacuum circuit breaker having a magnetic member for generating a longitudinal magnetic field between a pair of contact members for making electric connection and break.

2. Description of the Prior Art

A vacuum circuit breaker normally comprises, as shown in FIG. 1, a vacuum container 1 having an insulating container 2 with both end opening portions thereof being closed by covers 3*a* and 3*b*, and a pair of electrodes. The paired electrodes comprise contacts 4 and 5 which are arranged to face each other in the vacuum container 1 and conductive bars 6 and 7 which pass through the covers 3*a*, 3*b* and inserted into the vacuum container 1, respectively. The contacts 4 and 5 are provided on the end portions of the conductive bars 6 and 7, respectively. One conductive bar 7 is movable in the axial direction by an operation mechanism (not shown) such that one contact (to be referred to as "fixed contact" hereinafter) 4 can contact with and release from the other contact (to be referred to as "movable contact" hereinafter) 5.

A bellows 8 is provided between the cover 3*a* and the conductive bar 7 to tightly hold vacuum the inside of the vacuum container 1 and to allow the conductive bar 7 to move in the axial direction. Reference numeral 9 denotes a shield provided so as to surround the contacts 4 and 5 as well as the conductive bars 6 and 7.

The vacuum circuit breaker is normally energized when both of the contacts contact with each other. In this state, when the conductive bar 7 moves in the direction indicated by an arrow M, the movable contact 5 separates from the fixed contact 4 and an arc is generated between the contacts 4 and 5. The arc is maintained by generating a metallic vapor from a cathode such as a movable contact 5. As the contacts are distant from each other, the arc cannot be maintained, no current flows, and the generation of the metallic vapor stops to thereby complete breaking.

The arc generated between the contacts 4 and 5 turns into an extremely unstable condition by the interaction between a magnetic field generated by the arc itself and a magnetic field generated by an external circuit if the current to be broken is high. As a result, the arc moves on surfaces of the contacts and is biased to end portions or peripheral portions of the contacts. These arced portions are locally heated and a large quantity of metallic vapors are discharged, so that the degree of vacuum in the vacuum container 1 is thereby lowered. The breaking characteristics of the vacuum circuit breaker thus deteriorates. If the contacts are integrally formed on the electrodes, the arc may move on surfaces of the electrodes.

To avoid the deterioration of the breaking characteristics, there have been proposed, for example, (a) an electrode structure in which the contact surfaces have larger areas; (b) that in which a spiral slit is provided on the surfaces of the contacts or on the surfaces of the electrodes to rotate the arc; and (c), as shown in FIG. 2, a longitudinal magnetic field parallel to the arc is applied to the gap between the contacts by means of circumferential components of self-current which flow coil electrodes 10 and 10' being provided on the back of the contacts 4 and 5, respectively.

In a case of the electrode structure of (a) above, a biased arc may still be generated as described above. As a result, the contacts (electrodes) are locally molten and a vapor is generated more, whereby it may make circuit breaking impossible.

In a case of the electrode structure of (b) above, it is also impossible to uniformly flow current across the entire areas of the contacts, with the result that the phenomenon as same as the case of (a) occurs.

In a case of the electrode structure of (c) above, if current flows across the coil electrodes on the back of the contacts, a magnetic field is generated between the contacts in a direction perpendicular to the contact surface. During breaking operation, the arc generated between the both contacts is restricted by the longitudinal magnetic field. The arc distribution becomes the same as that of the line of magnetic force between the contacts. However, the distribution is not necessarily uniform and parallel. In addition, there occurs a phenomenon that the arc does not strike perpendicular to the contact surface and even shifts from the space between the contacts to the outside in the vicinity of the end portions of the respective contacts, with the result that expected breaking characteristics may not be exhibited.

As stated above, various improvements have been tried so far to contacts as well as electrode structures having the contacts provided thereon. Some of them, however, provide insufficient breaking characteristics and others push up cost.

SUMMARY OF THE INVENTION

With these problems in mind, it is therefore an object of the present invention to provide an electrode arrangement of a vacuum circuit breaker capable of controlling magnetic field distribution between the contact members in an optimum manner and enhancing breaking characteristics.

It is another object of the present invention to provide an electrode arrangement of a vacuum circuit breaker having a magnetic device for suitably providing longitudinal magnetic field between a pair of contact members at which electric connection is made and broken.

It is still another object of the present invention to provide an electrode arrangement of a vacuum circuit breaker, having a magnetic device that will not suffer a decrease in its ability to withstand high voltage levels and prevent increases in the restriking frequency while improving its arc-resistant property.

In order to achieve the above-mentioned object, an electrode arrangement of a vacuum circuit breaker for making and breaking electrical connection according to the present invention comprises: a pair of contact members which are adopted for making contact to and release from each other by relatively moving to and from each other along a predetermined direction; a pair of electrically conductive bars being connected to said pair of contact members, respectively, for providing electric conduction to the contact members; and a magnetizing device with a magnetic body for generating magnetic field parallel to the predetermined direction between the contact members, the magnetic body being composed of an iron alloy comprising 0.02 to 1.5% by weight of carbon and iron.

According to one aspect of the present invention, the carbon is contained in the iron alloy of the magnetic body as particles having an average particle diameter of 0.01 to 10 $\mu$m.

In another aspect of the present invention, the iron alloy of the magnetic body further comprises at least one of manganese and silicon.

In still another aspect of the present invention, said pair of contact members is composed of an electrically conductive material comprising a conductive component and an arc-resistant component, wherein the electrically conductive component is at least one of copper and silver, and the arc-resistant component is selected from the group consisting of Ti, Zr, V, Nb, Ta, Cr, Mo, W, carbides thereof and borides thereof and has a melting temperature of 1500° C. or more.

In another aspect of the present invention, said pair of electrically conductive bars are aligned in said predetermined direction, each of said pair of contact members has a contacting surface at which contact of the contact members is made, and the contacting surface is perpendicular to said predetermined direction.

In still another aspect, the magnetic body comprises at least one pair of magnetic members, one of said magnetic members is arranged on one of said pair of contact members, and the other magnetic member is arranged on the other contact member.

Each of the magnetic members may have a shape such that, when the magnetic member is magnetized by a circumferential magnetic field, open-loop magnetic fluxes along the magnetic field is created in the magnetic member.

Each of said pair of contact members may have at least one electrically conductive pins connected to the contact member in parallel to said predetermined direction, and the circumferential magnetic field magnetizing the magnetic members is generated from the electrically conductive pins.

BRIEF DESCRIPTION OF THE DRAWINGS

The features and advantages of an electrode arrangement of a vacuum circuit breaker according to the present invention over the prior art devices will be more clearly understood from the following description of the preferred embodiments of the present invention taken in conjunction with the accompanying drawings in which like reference numerals designate the same or similar elements or sections throughout the figures thereof and in which.

DETAILED DESCRIPTION OF THE PREFERRED EMBODIMENTS

The present invention will now be described in detail.

An arc generated between the contacts of a vacuum circuit breaker can be controlled by generating a magnetic field parallel to the longitudinal direction, that is, the direction in which current flows between the contacts (the magnetic field like the above will be referred to as "longitudinal magnetic field" hereinafter). The vacuum circuit breaker using coils as mentioned above is designed to generate a longitudinal magnetic field between the contact members by current flowing through the coils. However, it has become known that there is a suitable longitudinal magnetic field for providing a high arc-resistant vacuum circuit breaker and such a magnetic field is necessary to generate. In other words, it is necessary to adjust the distribution of the longitudinal magnetic field generated between the contacts or the magnetic flux density distribution. Specifically, it is desired that the periphery of the contacts has a higher magnetic flux density than the central portion thereof has. To adjust the generation of the longitudinal magnetic field, it is effective to apply magnetic field generating means using a magnetic material as means for generating a longitudinal magnetic field.

If, for example, an annular magnetic member along the outer peripheral portion of the contact is provided on each of the both contacts in a vacuum circuit breaker in which coils are arranged so that the axial direction of the coils corresponds to the longitudinal direction of the vacuum circuit breaker, then the magnetic flux density in the vicinity of the outer peripheral portion of the contact is higher in the magnetic field generated by the current from the coils and an intensified longitudinal magnetic field can be obtained between a pair of adjacent magnetic members.

Alternatively, it is possible to generate a longitudinal magnetic field from a magnetic flux perpendicular to the longitudinal direction of the vacuum circuit breaker, not using coils but using a magnetic member.

Figure 3:
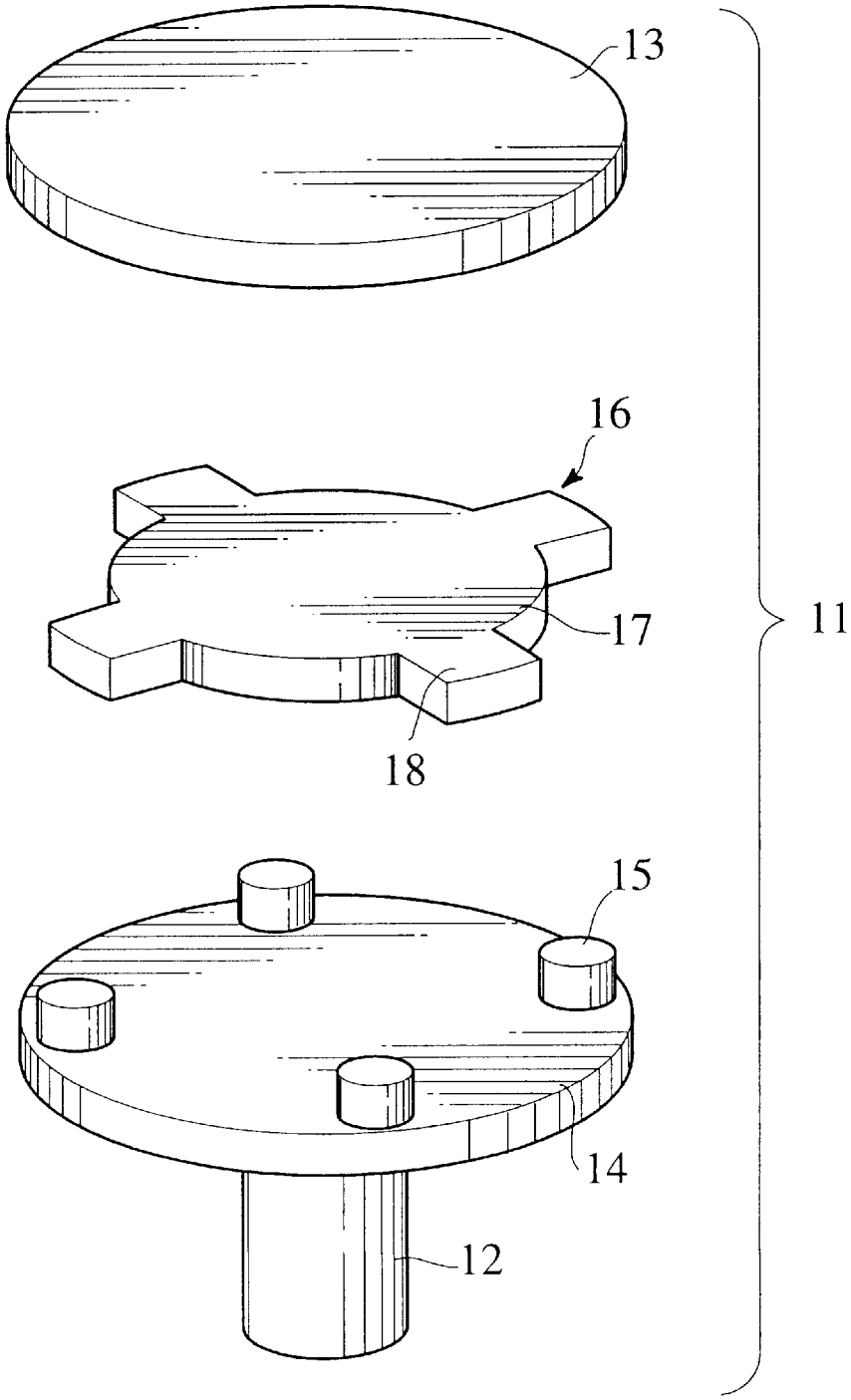
FIG. 3 is an exploded perspective view showing an example of an electrode which is paired to fabricate a vacuum circuit breaker according to the present invention.
Figure 4:
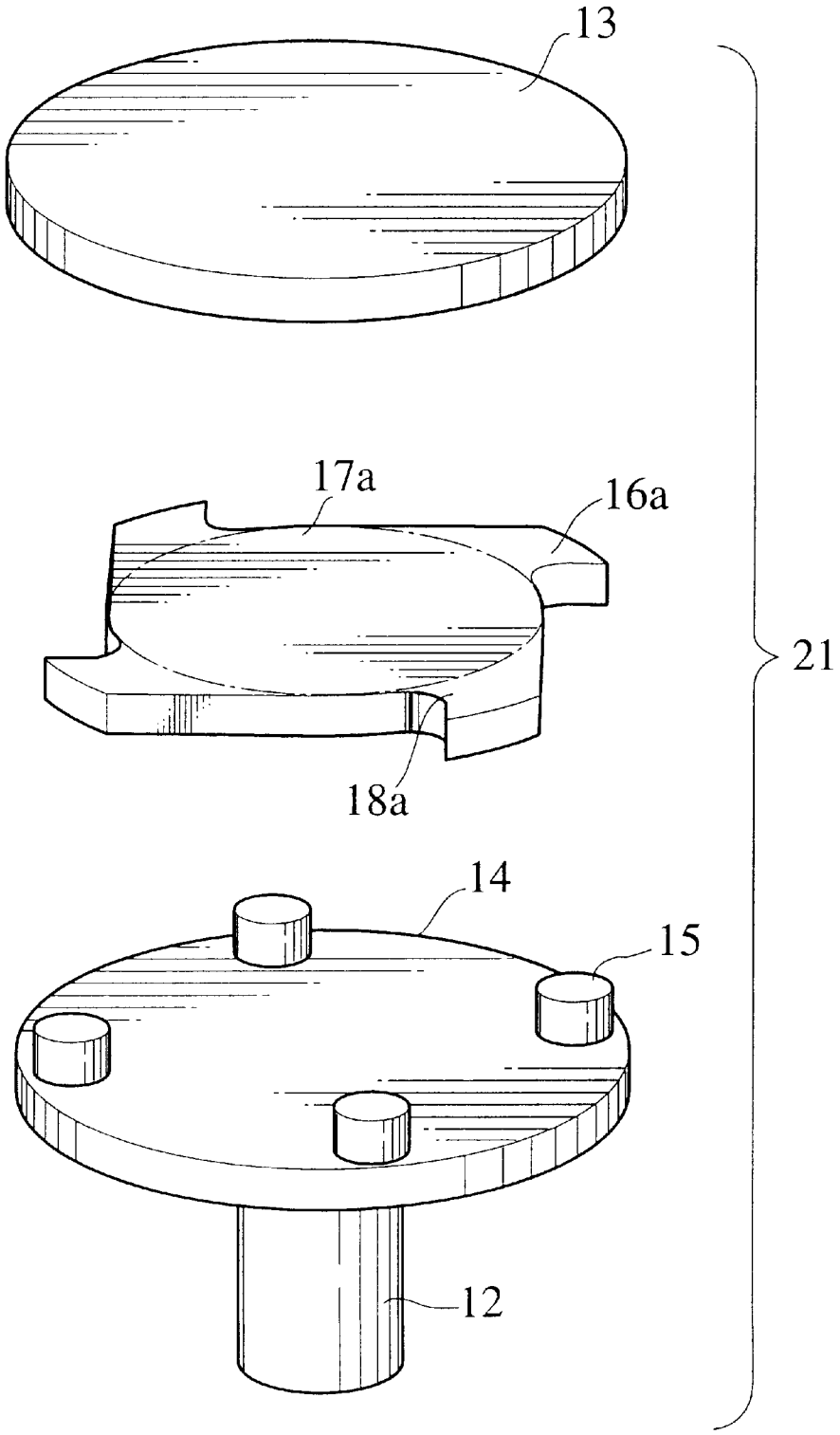
FIG. 4 is an exploded perspective view showing another example of the electrode of the vacuum circuit breaker according to the present invention.
Figure 5:
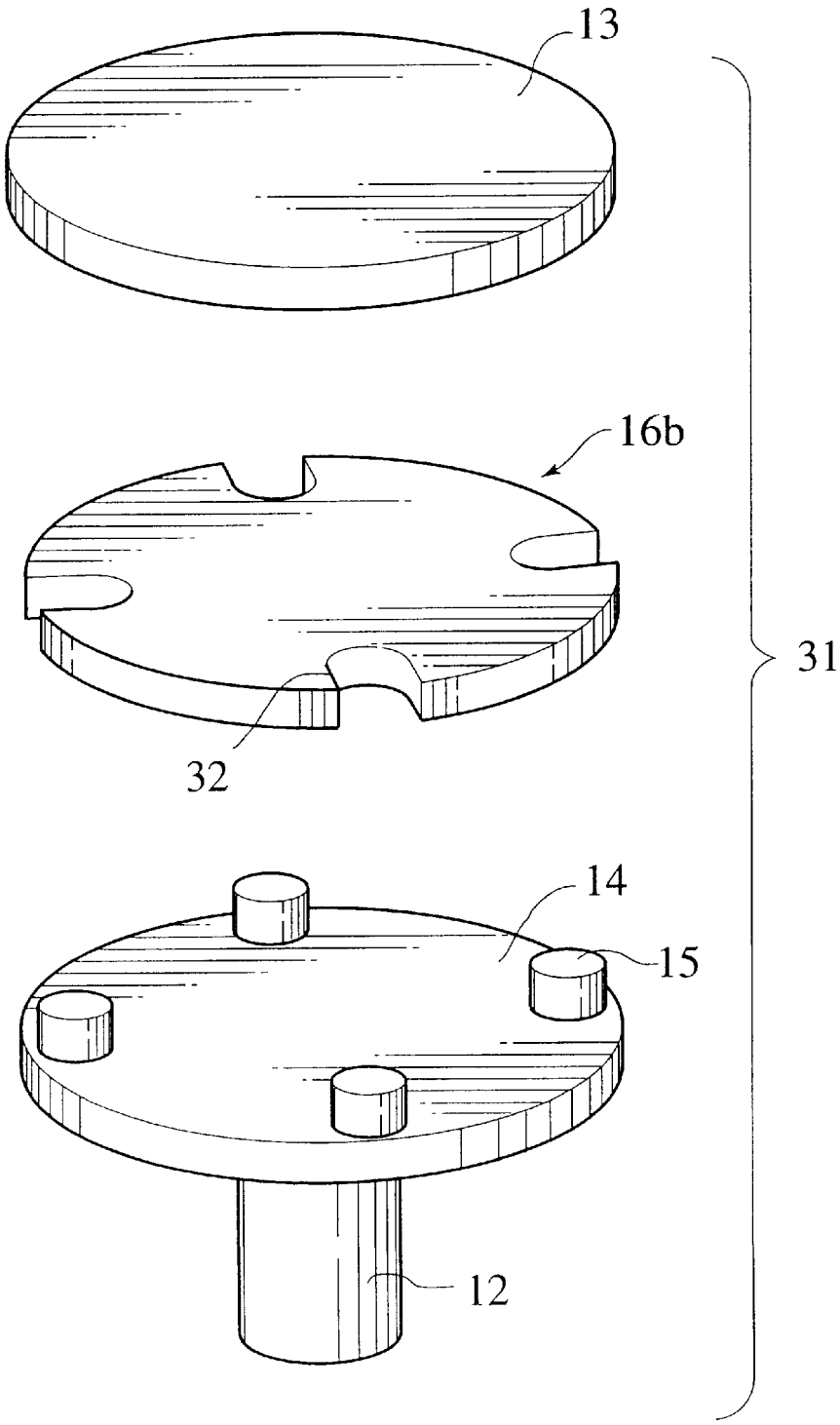
FIG. 5 is an exploded perspective view showing further example of the electrode of the vacuum circuit breaker according to the present invention.

If a magnetic body is positioned in the magnetic field, it is magnetized in accordance with the intensity of an external magnetic field and the magnetic permeability of the magnetic material. If a magnetic flux generated by magnetization provides not a closed loop but an open loop in the magnetic body, then the distal end portions of the magnetic body where the magnetic flux is terminated act as magnetic poles. Using these features, if the magnetic bodies are appropriately arranged and magnetized by a magnetic field generated around the electrodes of the activated vacuum circuit breaker, then a longitudinal magnetic field is possibly generated and adjusted as required. FIGS. 3 through 5 are views for describing an example of the structure of the vacuum circuit breaker of this type and show one of a pair of electrodes of the vacuum circuit breaker.

Figure 1:
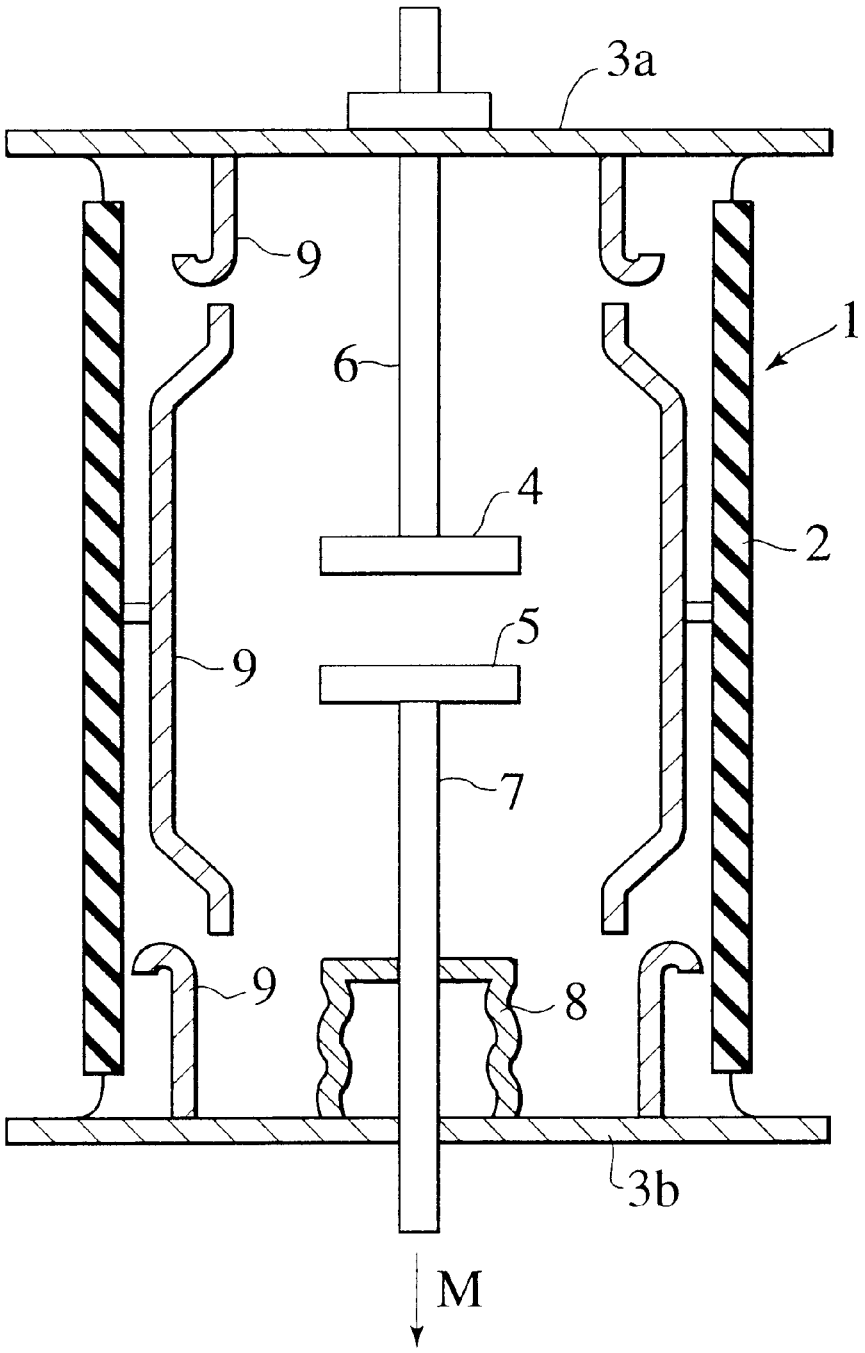
FIG. 1 PRIOR ART
FIG. 1 is a schematic illustration showing a conventional vacuum circuit breaker, for explaining a basic construction of a vacuum circuit breaker.
Figure 2:
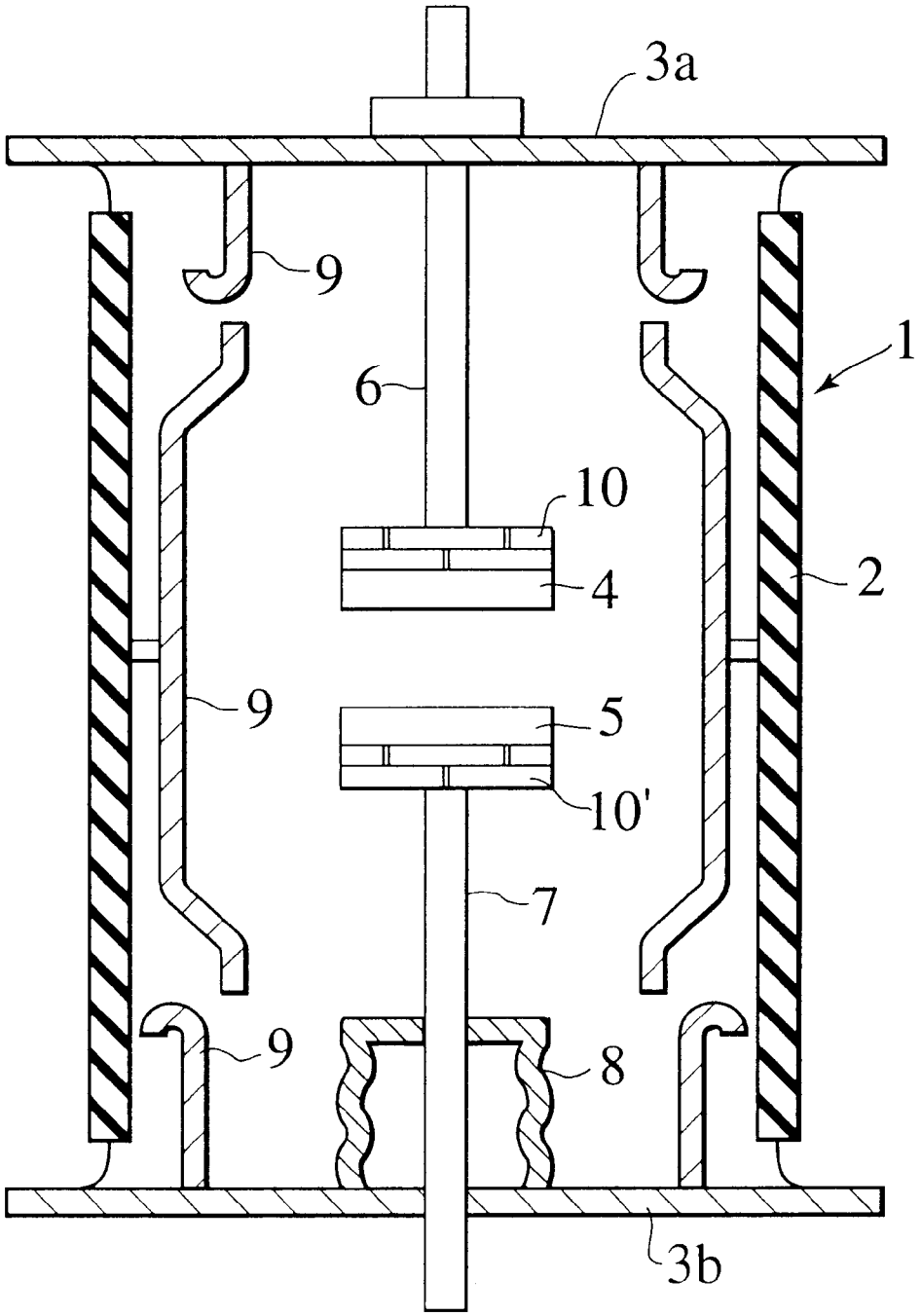
FIG.2 PRIOR ART
FIG. 2 is a schematic side view showing another conventional vacuum circuit breaker which uses a coil.

The electrode shown in each of FIGS. 3 to 5 is paired with another same electrode and constructed into a vacuum circuit breaker as shown in FIG. 1. In FIGS. 3 through 5, a magnetic body is magnetized by a circumferential magnetic field generated by current flowing in the longitudinal direction and open-loop magnetic fluxes along the magnetic field is created in the magnetic body to thereby form magnetic poles. The magnetic bodies are arranged in such a manner that, when a pair of contacts of electrodes are contacted with each other, the north (N) pole (or the south (S) pole) of the magnetic body of one electrode is disposed close to the S pole (or the N pole) of the magnetic body of the other electrode and a longitudinal magnetic field is generated therebetween.

In FIG. 3, an electrode 11 comproses a conductive bar 12, a disc-shaped contact member 13, a disc part 14 provided at the conductive bar 12, four cylindrical current-carrying pins 15 formed on the peripheral portion of the contact member 13 side of the disc part 14 at intervals of 90 degrees, and a magnetic member 16. The magnetic member 16 is installed among the conductive pins 15 and held between the contact member 13 and the disc part 14. The electric current flows across the contact member 13 through the current-carrying pin 15 via the disc part 14 from the conductive bar 12. The magnetic member 16 comprises a circular central portion 17 having a diameter smaller than the distance between the two diagonal current-carrying pins 15 and four protruding parts 18 protruding in the radial direction from the central part 17. If the magnetic member 16 is installed among the current-carrying pins 15, the respective protruding parts 18 of the magnetic member 16 are positioned in close proximity to the current-carrying pins 15. By circumferential magnetic fields generated around the current-carrying pins 15 by the current flowing through the current-carrying pins 15, the magnetic member 16 in the region of the protruding parts 18 is magnetized to form an open loop at each of the protruding parts 18. With the above construction, if a pair of electrodes are arranged to face each other, the magnetic members 16 of the electrodes are located adjacent to each other via the thin contact members 13. If current is carried in such a condition that the protruding parts of one magnetic member are partially superposed on those of the other magnetic member, a longitudinal magnetic field is generated between the two magnetic members from the north pole of the magnetic member of one electrode toward the south pole of the magnetic member of the other electrode.

An electrode 21 shown in FIG. 4 is the same as that in FIG. 3 except for a magnetic member 16*a* of different shape from that in FIG. 3. Protruding parts 18*a* of the magnetic member 16*a* spirally protrude from the central portion 17*a* in a key pattern. The shape of the protruding parts 18*a* is more suitable for magnetic fields generated around the current-carrying pins than in FIG. 3, allowing more intense magnetic fields to be generated.

In the electrode 31 shown in FIG. 5, a magnetic member 16*b* is formed to have four U-shaped notches 32 provided at a disc having the same dimensions as those of the contact member 13. The other elements shown in FIG. 5 are the same as those in FIG. 3. If the magnetic member 16*b* is installed at the disc part 14, the current-carrying pins 15 are inserted into the notches 32 of the magnetic member 16*b*. The magnetic flux generated by current flowing through the pins 15 is formed into an open-loop flux by the notches 32. Two magnetic poles are formed on the side surface at each of the notches 32. If a pair of electrodes are arranged to face each other and the notches of one magnetic member are arranged not to be superposed on but adjacent to those of the other magnetic member, then a longitudinal magnetic field is suitably formed from one magnetic member to the other magnetic member.

Although the electrodes 11, 21 and 31 shown in FIGS. 3 through 5 are intended to use four current-carrying pins 15, the number of pins can be changed appropriately. It is also possible to generate a longitudinal magnetic field without use of current-carrying pins. For example, a circular arc shaped magnetic member may be provided around the conductive bar on the back face (which is opposite to the contact surface for providing electrical connection) of the contact member of each of a pair of electrodes shown in FIG. 1. Said pair of electrodes are arranged such that one end of the magnetic member of one electrode correspondingly faces the other end of the magnetic member of the other electrode. As a result, a longitudinal magnetic field can be formed from said one end of one magnetic member toward said other end of the other magnetic member.

The above-described magnetic member is formed so as to provide a longitudinal magnetic field having high parallelism of the magnetic flux and being perpendicular to the contact surface to help the breaking characteristics of the vacuum circuit breaker enhance. To obtain a desired magnetic flux density even with low current, a magnetic member made of a magnetic material of high magnetic permeability, preferably having a saturation magnetic flux density of not less than 0.5 $Wh/m^2$ is used.

According to studies of the inventors of the present invention, the composition and the like of magnetic material for making the magnetic member causes changes in the breaking characteristics, voltage withstanding properties and arc generation of the vacuum circuit breaker. The reason is not clear, however, it is considered that the workability and machinability of the material, physical properties such as strength and chemical properties such as vaporization may indirectly affect those properties.

Among various magnetic materials, pure iron has excellent magnetic permeability. However, due to high malleability, pure iron does not have enough mechanical workability. In addition, the strength of the pure iron is low and insufficient for the material used in the vacuum circuit breaker. In this respect, an alloy of iron and other components, which exhibits sufficient strength and workability, is excellent for practical use.

As a result of studying various iron alloys, the inventor has found that an iron alloy containing carbon of 0.02 to 1.2% by weight is excellent for the material of the vacuum circuit breaker. If applied to the magnetic member of the vacuum circuit breaker, an alloy containing carbon of 0.02% or more percentage by weight has good physical properties such as workability, whereas an alloy containing carbon of more than 1.2% by weight has lower breaking characteristics and inferior voltage withstanding properties to thereby generate a locally concentrated arc.

Moreover, an Fe-C-Mn alloy, an Fe-C-Si alloy, an Fe-C-Mn-Si alloy which contain manganese of 0.1 to 2.0% by weight and/or silicon of 0.01 to 5.0% by weight can be appropriately used as the magnetic material for the vacuum circuit breaker. Iron is an element which tends to be easily oxidized, and carbon, manganese and silicon, if combined with iron, have a reducing action on iron. For that reason, the above-mentioned iron alloys contain less oxygen to make unnecessary gas discharge difficult at a time an arc is generated. The iron alloys of these types have good workability and can therefore obtain a surface without burrs which easily cause an arc to make the state unstable.

It is preferable that the carbon in such an iron alloy is contained in a state of particles having an average particle diameter of 0.01 to 10 $\mu$m.

In the above-described embodiments, the magnetic member is provided on the back face of the contact member. To apply a longitudinal magnetic field generated by the magnetic member effectively between the contact members, the magnetic member is preferably closer to the contact surface. To this end, it is possible to bury the magnetic member in the back face of the contact member. It is also possible to form a contact member partly serving as the magnetic member by integrally mold the conductive material and the magnetic material. If current-carrying pins as shown in FIGS. 3 through 5 are used, the magnetic member requires acting on magnetic fields from the current-carrying pins and cannot be completely buried into the contact. If using a longitudinal magnetic field by coils is used, it is possible to completely bury the magnetic member into the contact. However, the above-stated iron alloys have high electric resistance and are not difficult to use as a conductive part of the electrode (that is also mentioned as for other magnetic materials). It is, therefore, necessary to take it into consideration to prevent the magnetic member from becoming a hindrance to the continuity and conductivity of the electrode.

Furthermore, if a magnetic material in which the distribution of saturation magnetic flux density is partially different is used, the magnetic flux density varies on the contact surface. Using this property, the distribution of the magnetic flux density between the contact members can be adjusted, thereby making it possible to control a state in which an arc is generated on the contact surface and to stabilize breaking characteristics. Moreover, it is possible to cope with the change of current to be broken and exhibit stable breaking characteristics.

The contact member used for the electrode can be made of various conductive materials. It is preferable that the surface of the contact member is made of a conductive material comprising a conductive component and an arc-resistant component. An auxiliary component is added as required. As the conductive component, at least one of copper and silver can be used. The arc-resistant component is selected from the group consisting of Ti, Zr, V, Nb, Ta, Cr, Mo, W, and carbides thereof as well as borides thereof, and its melting temperature is 1500° C. or more. The auxiliary component is at least one which is selected from Bi, Te, Pb and Sb.

It is also possible to control the arc generation state, as required, by appropriately adjusting the composition of the contact. Specifically, if concentrations of the components are changed so that the outer periphery of the contact is higher than the center thereof in the concentration of arc-resistant components, the state of the arc is improved. Such a contact can be fabricated by, for example, partitioning the contact member into a plurality of parts having different component concentrations, forming a compact with use a material powder for every part, combining the respective compacts of the parts and then heating and sintering them to combine them. The compact for each part can be formed by mixing simple material powders according to the composition of the part to prepare the material powder, and by molding the material powder. The combined compacts are heated and sintered at a temperature equal to or lower than a melting temperature.

Alternatively, using only material powder for arc-resistant components, powder compacts each having a void distribution according to the component concentration are formed and then heated and sintered to thereby form a skeleton. Then, by infiltrating the heat-molten material for the conductive components into the void of the skeleton, a contact having partially different compositions can be fabricated. In that case, depending on the grain diameter of material powder, the compacting pressure for forming powder compacts, sintering time and temperature, the composition of the obtained contact member can be slightly adjusted or re-adjusted.

Alternatively, while a mixed material powder is sprayed onto the surface of a substrate made of, for example, copper and having a thickness of about 1 to 5 mm, the composition of the mixed material powder is changed according to the sprayed portions. It is thereby possible to obtain a deposit of a material powder having partially different compositions piled on the surface thereof. If heating and sintering the deposit, a contact having a sintered compact with a desired composition distribution on a surface thereof can be obtained. Molten mixture instead of the mixed powder may be used as material and melting-sprayed on the substrate surface.

If a silver braze or the like is used for connecting the contact member to other parts, then a copper plate, a silver plate or the like can be formed integrally with the Junction portion of the contact.

A vacuum circuit breaker is made by appropriately selecting and combining specific examples of the contact members and magnetic members as described above.

In the vacuum circuit breaker to be fabricated in accordance with the above description according to the present invention, the longitudinal magnetic field is appropriately applied, so that an arc is generated broadly in a range on the contact surface during breaking operation, and withstand characteristics and breaking characteristics are improved.

EXAMPLES

The present invention will be described in more detail with reference to examples.

Formation of Samples (Sample 1)

Iron material was poured into an alumina crucible and the crucible was placed within a vacuum induction melting furnace. The ion in the crucible was molten at a temperature of 1600° C. under in the atmosphere of vacuum degree of $10^{-4}$ torr and an iron ingot was prepared. After removing the surface layer of the ingot, an ion sheet of 1 m in length, 30 mm in thickness and 120 mm in width was formed. While the thickness of the ion sheet was gradually reduced by once about 12% of the initial thickness at temperatures of 950 to 1050° C., the ion sheet was rolled 19 times to thereby obtain an iron sheet of 2.5 mm in thickness. By machining the resultant iron sheet, a magnetic member in a shape as shown in FIG. 4 and having a maximum diameter of 40 mm, a diameter of 30 mm at the central portion and a width of 10 mm at the end portion of protruding parts was obtained.

With use of a Cu—25% Cr alloy ingot, a copper alloy sheet of 3 mm in thickness was formed by the same procedures as mentioned above, and it was machined to obtain a disc-shaped contact member of 40 mm in diameter.

The above-described magnetic member and the contact member were installed on a disc part including current-carrying pins of 5 mm in diameter and 2.5 mm in length and having the same composition as that of the contact member, thereby forming an electrode as shown in FIG. 4. The procedure was repeated to prepare a pair of electrodes. It is noted that the respective members were adhered to other members by silver-alloy brazing.

(Samples 2 to 7)

In each case of the samples 2 to 7, carbon powder and iron powder were mixed to each other to have a composition as shown in Table 1. The resultant mixture was poured into an alumina crucible and the crucible was placed in a vacuum induction melting furnace. The mixture in the crucible was molten at a temperature of 160° C. in the atmosphere of vacuum degree of $10^{-4}$ torr to thereby form an iron alloy ingot. After removing the surface layer of the ingot, an iron alloy sheet of 1 m in length, 30 mm in thickness and 120 mm in width was formed. While gradually reducing the thickness of the iron alloy sheet by once about 12% of the initial thickness at temperatures of 950 to 1050° C., the alloy sheet was rolled 19 times and an iron alloy sheet of 2.5 mm in thickness was obtained. The iron alloy sheet was machined to thereby form a pair of magnetic members having the same shape as that of the sample 1.

Furthermore, by the same operation as that of the sample 1, a pair of contact members were formed for each case. A pair of electrodes as shown in FIG. 4 were formed from the contact members and the above-obtained magnetic members, similarly.

(Samples 8 to 11)

In each case of the samples 8 to 11, carbon powder, silicon powder and iron powder were mixed to have composition as shown in Table 1, respectively. The resultant mixture was poured into an alumina crucible. The crucible was placed within a vacuum induction melting furnace and the mixture was molten at a temperature of 1600° C. in the atmosphere of vacuum degree of $10^{-4}$ torr to thereby form an iron alloy ingot. After removing the surface layer of the ingot, an iron alloy sheet of 1 m in length, 30 mm in thickness and 120 mm in width was formed. While gradually reducing the thickness of the sheet by once about 12% of the initial thickness, the sheet was rolled 19 times at a temperature 950 to 1050° C. and an iron alloy sheet of 2.5 mm in thickness was obtained. The iron alloy sheet was machined and a pair of magnetic members of the same shape as that of the sample 1 were fabricated.

Further, a pair of contact members were formed by the same operation as that of the sample 1 for each sample. A pair of electrode as shown in FIG. 4 was formed from the contact and each of the magnetic members thus obtained.

(Samples 12 to 16)

In each sample, using carbon powder, manganese powder and iron powder, a pair of magnetic members having composition as shown in Table 1 were formed by the same operations as those for the samples 8 to 11, respectively.

A pair of contact members were also formed by the same operation as that of the sample 1 for each sample. A pair of electrodes shown in FIG. 4 were formed from the contact members and the magnetic members obtained above.

(Samples 17 to 22)

In each sample, using carbon powder, manganese powder, silicon powder and iron powder, a pair of magnetic members having composition as shown in Table 1 were formed, respectively by the same operations as for the samples 8 to 11.

Further, a pair of contact members were formed by the same operation as that of the sample 1 for each sample. A pair of electrodes as shown in FIG. 4 were formed from the contact members and the magnetic members as obtained.

(Samples 23 to 24)

In each sample, a pair of magnetic members having composition as shown in Table 1 were formed by repeating the same operations as for the samples 8 to 11 except using a carbon powder having a different particle size distribution.

Moreover, a pair of contact members were formed by the same operation as that of the sample 1 for each sample. A air of electrodes as shown in FIG. 4 were formed by combining the contact members with the magnetic members obtained.

(Samples 25 to 28)

In each sample, magnetic members having composition and carbon average particle diameter as shown in Table 1 were formed, respectively, by repeating the same operation as for the samples 8 to 11, except using carbon powder having a different particle size distribution and using not iron powder but iron alloy powder.

Here, the average particle diameter of the carbon contained in the obtained magnetic member was determined by: calculating the volume of a carbon particle by microscopic measurement method; calculating a diameter while assuming the shape of the carbon particle is circular; and taking an average of the obtained diameters of 400 particles detected in a 1 $cm^2$ area. The obtained value is shown in Table 1 at the column of Particle Size of Carbon.

Furthermore, a pair of contact members were formed by the same operation as that of the sample 1 for each sample. A pair of electrodes as shown in FIG. 4 were formed by combining the contact members with the magnetic members obtained.

(Samples 29 to 31)

In each sample, using carbon powder, manganese powder, chromium powder, nickel powder, molybdenum powder, copper powder, tungsten powder, vanadium powder and iron powder, magnetic members having composition rations shown in Table 1 were formed, respectively, by the same operations as for the samples 8 to 11.

Further, a pair of contact members were formed by the same operation as that of the samples 1 to 5 for each sample. Combining the contact members with the magnetic members obtained above, a pair of electrode as shown in FIG. 4 were formed.

(Samples 32 to 41)

In each sample, the same magnetic members as the sample 13 were formed.

Further, a pair of contact members were formed from the alloy ingot of composition shown in Table 1 by the same operation as that of the sample 1 for each sample.

Using each of the above-stated magnetic members and the contact, a pair of electrodes shown in FIG. 4 were formed, as well.

Measurement of the Samples

The following measurement was conducted using the above prepared samples 1 to 41.

[Breaking Property]

Each pair of the sample electrodes 1 to 41 was mounted on a detachable vacuum circuit breaker having the structure as shown in FIG. 1 such that the positions of the upper and lower current-carrying pins were met to align the pins. After conducting predetermined baking and aging, current of 7.2 KV/50 Hz/20 KA was carried and breaking operation was repeated 1000 times at a predetermined contact-releasing speed. At this time, the restriking frequency was measured. The measurement was conducted for four different vacuum circuit breakers and the maximum values and minimum values of the restriking frequencies are shown in Table 2 for evaluating the breaking property.

[Broadness of Arc]

Each pair of electrodes of the samples 1 to 41 was mounted on the detachable vacuum circuit breaker having a structure as shown in FIG. 1. After predetermined baking and aging, current of 7.2 KV/50 Hz/12 KA was carried and breaking operation was repeated 4 times at a predetermined contact-releasing speed. Thereafter, the contact surfaces of the electrodes were observed with a microscope and the areas of portions which were damaged by the arc stroken thereon were measured. The value of areas thus obtained was classified by a relative evaluation in which the area for the sample 20 is set at 100%. The result is shown in Table 2 for the evaluation of the broadness of the arc. It is noted that in Table 2, reference symbol A denotes 130% or more, B: 115 to 139%, C: 105 to 115%, D: 95 to 105% and E: 95% or less.

[Voltage Withstanding Property]

Each pair of electrodes which were subjected to the measurement of broadness of the arc were re-mounted on the vacuum circuit breaker. While the distance between the electrodes was fixed to 8 mm, the voltage applied was gradually increased such that the voltage between the electrodes increases by 1 kV per once. The voltage value (static withstanding voltage) at a time a spark occurred was measured. The voltage value thus obtained was converted into a relative value such that the voltage value for the sample 20 is set at 1. The respective values are shown in Table 2 for the evaluation of the voltage withstanding property.

TABLE 1

| | MAGNETIC MEMBER | | | | | CONTACT |
|---|---|---|---|---|---|---|
| | COMPOSITION (WT %) | | | | Particle Size of | MEMBER COMPOSITN. |
| SAMPLE | Carbon | Mn | Si | Balance | Carbon (μm) | (BY WT.) |
| 1 | <0.01 | <0.01 | <0.01 | Fe | — | Cu-25% Cr |
| 2 | 0.02 | <0.01 | <0.01 | Fe | 0.1–1 | Cu-25% Cr |
| 3 | 0.08 | <0.01 | <0.01 | Fe | 0.1–1 | Cu-25% Cr |
| 4 | 0.4 | <0.01 | <0.01 | Fe | 0.1–1 | Cu-25% Cr |
| 5 | 0.8 | <0.01 | <0.01 | Fe | 0.1–1 | Cu-25% Cr |
| 6 | 1.2 | <0.01 | <0.01 | Fe | 0.1–1 | Cu-25% Cr |
| 7 | 3.5 | <0.01 | <0.01 | Fe | 0.1–1 | Cu-25% Cr |
| 8 | 0.2 | <0.01 | 0.01 | Fe | 0.1–1 | Cu-25% Cr |
| 9 | 0.2 | <0.01 | 1.0 | Fe | 0.1–1 | Cu-25% Cr |
| 10 | 0.2 | <0.01 | 5.0 | Fe | 0.1–1 | Cu-25% Cr |
| 11 | 0.2 | <0.01 | 13.0 | Fe | 0.1–1 | Cu-25% Cr |
| 12 | 0.2 | 0.1 | <0.01 | Fe | 0.1–1 | Cu-25% Cr |
| 13 | 0.2 | 0.3 | <0.01 | Fe | 0.1–1 | Cu-25% Cr |
| 14 | 0.2 | 1.3 | <0.01 | Fe | 0.1–1 | Cu-25% Cr |
| 15 | 0.2 | 2.0 | <0.01 | Fe | 0.1–1 | Cu-25% Cr |
| 16 | 0.2 | 3.7 | <0.01 | Fe | 0.1–1 | Cu-25% Cr |
| 17 | 0.2 | 0.3 | 0.1 | Fe | 0.1–1 | Cu-25% Cr |
| 18 | 0.2 | 0.3 | 0.75 | Fe | 0.1–1 | Cu-25% Cr |
| 19 | 0.2 | 0.3 | 1.5 | Fe | 0.1–1 | Cu-25% Cr |
| 20 | 0.2 | 0.3 | 3.0 | Fe | 0.1–1 | Cu-25% Cr |
| 21 | 0.2 | 0.3 | 5.0 | Fe | 0.1–1 | Cu-25% Cr |
| 22 | 0.2 | 0.3 | 8.3 | Fe | 0.1–1 | Cu-25% Cr |
| 23 | 0.2 | 0.3 | <0.01 | Fe | 0.01–0.1 | Cu-25% Cr |
| 24 | 1.2 | 0.4 | 0.2 | Fe | 0.0–3 | Cu-25% Cr |
| 25 | 0.5 | 0.9 | 2.0 | Fe-0.6% Cu | 0.05–5 | Cu-25% Cr |
| 26 | 0.3 | 0.3 | 0.1 | Fe-3.6% Ni | 0.1–5 | Cu-25% Cr |
| 27 | 0.4 | 0.3 | 0.2 | Fe-0.9% Cr | 0.3–10 | Cu-25% Cr |
| 28 | 0.4 | 0.3 | 0.2 | Fe-0.9% Cr | 0.5–30 | Cu-25% Cr |
| 29 | Fe-0.4% C-0.6% Mn-0.9% Cr-0.3% Ni-0.2% Mo-0.1% Cu | | | | <0.01 | Cu-25% Cr |
| 30 | Fe-0.3% C-0.5% Mn-0.1% Cr-3.5% Ni-0.04% Mo-0.1% Cu | | | | <0.01 | Cu-25% Cr |
| 31 | Fe-0.3% C-0.3% Mn-14.0% Cr-0.2% Ni-0.25% W-1.1% V | | | | <0.01 | Cu-25% Cr |
| 32 | 0.2 | 0.3 | <0.01 | Fe | 0.1–1 | Cu-25% Cr-0.2% Bi |
| 33 | 0.2 | 0.3 | <0.01 | Fe | 0.1–1 | Cu-50% Cr |
| 34 | 0.2 | 0.3 | <0.01 | Fe | 0.1–1 | Cu-50% Cr-5% W |
| 35 | 0.2 | 0.3 | <0.01 | Fe | 0.1–1 | Cu-50% Cr-5% Mo |
| 36 | 0.2 | 0.3 | <0.01 | Fe | 0.1–1 | Cu-50% Cr-5% Ta |
| 37 | 0.2 | 0.3 | <0.01 | Fe | 0.1–1 | Cu-50% Cr-5% Nb |
| 38 | 0.2 | 0.3 | <0.01 | Fe | 0.1–1 | Cu-50% Cr-5% Ti |
| 39 | 0.2 | 0.3 | <0.01 | Fe | 0.1–1 | Cu-40% TiB |
| 40 | 0.2 | 0.3 | <0.01 | Fe | 0.1–1 | Cu-30% W |
| 41 | 0.2 | 0.3 | <0.01 | Fe | 0.1–1 | Ag-40% WC |

TABLE 2

| SAMPLE | BREAKING PROPERTY | BROADNESS OF ARC | VOLTAGE WITHSTANDING PROPERTY |
|---|---|---|---|
| 1 | 0–2 | A | 1.0 |
| 2 | 0–2 | A | 1.0 |
| 3 | 0–3 | B | 1.0 |
| 4 | 1–3 | B | 1.0 |
| 5 | 2–5 | C | 1.0 |
| 6 | 3–5 | C | 1.0 |
| 7 | 5–21 | E | 0.65–1.0 |
| 8 | 0–2 | A | 0.9–1.0 |
| 9 | 1–2 | B | 1.0 |
| 10 | 2–4 | B | 1.0 |
| 11 | 5–17 | E | 0.8–1.0 |
| 12 | 2–3 | A | 1.3 |
| 13 | 2–4 | B | 1.2 |
| 14 | 4–6 | C | 1.1 |

TABLE 2-continued

| SAMPLE | BREAKING PROPERTY | BROADNESS OF ARC | VOLTAGE WITHSTANDING PROPERTY |
|---|---|---|---|
| 15 | 4–7 | C | 1.0 |
| 16 | 8–29 | E | 0.9 |
| 17 | 2–4 | B | 1.15 |
| 18 | 2–6 | C | 1.05 |
| 19 | 4–7 | C | 1.0 |
| 20 | 5–7 | D | 1.0 |
| 21 | 5–8 | D | 0.9 |
| 22 | 13–34 | E | 0.7 |
| 23 | 1–4 | A | 1.0–1.15 |
| 24 | 3–6 | B | 1.0–1.1 |
| 25 | 5–8 | C | 0.95–1.05 |
| 26 | 4–7 | C | 0.95–1.0 |
| 27 | 3–9 | D | 0.9–0.95 |
| 28 | 5–52 | E | 0.25–0.9 |

TABLE 2-continued

| SAMPLE | BREAKING PROPERTY | BROADNESS OF ARC | VOLTAGE WITHSTANDING PROPERTY |
|---|---|---|---|
| 29 | 2–8 | C | 0.9–1.0 |
| 30 | 4–6 | G | 0.9–1.0 |
| 31 | 5–9 | D | 0.9–1.0 |
| 32 | 4–7 | C | 0.9–1.0 |
| 33 | 2–4 | B | 1.0 |
| 34 | 2–5 | B | 1.1 |
| 35 | 2–4 | B | 1.1 |
| 36 | 1–4 | B | 1.1 |
| 37 | 2–5 | B | 1.1 |
| 38 | 2–5 | B | 1.1 |
| 39 | 3–6 | B | 1.1 |
| 40 | 4–7 | C | 1.1 |
| 41 | 5–8 | C | 1.0 |

The results of the samples 2 to 7 indicate that the voltage withstanding property is good and the contact surface is broadly used when an arc occurs, as for the magnetic member with carbon content of 0.02 to 1.2% by weight. Even with low breaking current, the area in which the arc occurs is large. If the carbon content exceeds this range, the voltage withstanding property of the electrodes abruptly decreases and the restriking frequency varies widely in respect of the breaking property. From the data obtained, it can be therefore evaluated that the carbon content of 0.02 to 0.4% by weight is most desirable and that good operation is possible even in the range of 0.8 to 1.2% by weight.

From the results of the samples 8 to 11, if silicon of 0.01 to 5% by weight is added, it is possible to obtain an electrode having, in particular, good arc spread and having a desired voltage withstanding property as well as the breaking property.

According to the samples 12 to 16, if manganese of 0.1 to 2.0% by weight is added, it is possible to obtain an electrode having, in particular, good voltage withstanding property. According to the samples 17 to 22, it appears that, if manganese and silicon are jointly used, the contents of those elements are desirably suppressed better than a case where either manganese or silicon is solely used.

According to the samples 23 to 31, a magnetic member to which components such as copper, nickel and chromium are further added exhibits good characteristics for the circuit breaker.

According to the sample 28, if carbon particles are excessively large in dimension, the voltage withstanding property becomes greatly uneven. It is also observed that restriking of arcs occurs more frequently.

The results of the samples 32 to 41 indicate that, even if the composition of a contact member changes, the advantage of the magnetic member according to the present invention can be efficiently exhibited.

It must be understood that the invention is in no way limited to the above embodiments and that many changes may be brought about therein without departing from the scope of the invention as defined by the appended claims.

What is claimed is:

1. An electrode arrangement of a vacuum circuit breaker for making and breaking electrical connection, comprising:

a pair of contact members which are adopted for making contact to and releasing from each other by relatively moving to and from each other along a predetermined direction;

a pair of electrically conductive bars being connected to said pair of contact members, respectively, for providing electric conduction to the contact members; and a magnetizing device with a magnetic body for generating a magnetic field parallel to the predetermined direction between the contact members, the magnetic body being composed of an iron alloy comprising iron and 0.02 to 1.5% by weight carbon.

2. The electrode arrangement of claim 1, wherein the carbon contained in the iron alloy of the magnetic body forms particles having an average particle diameter of 0.01 to 10 $\mu$m.

3. The electrode arrangement of claim 1, wherein the iron alloy of the magnetic body further comprises at least one of manganese and silicon.

4. The electrode arrangement of claim 1, wherein the iron alloy of the magnetic body further comprises 0.1 to 15% by weight of manganese.

5. The electrode arrangement of claim 1, wherein the iron alloy of the magnetic body further comprises 0.01 to 5% by weight of silicon.

6. The electrode arrangement of claim 1, wherein the magnetic body has a saturation magnetic flux density of not less than 0.5 $Wh/m^2$.

7. The electrode arrangement of claim 1, wherein said pair of contact members is composed of an electrically conductive material comprising a conductive component and an arc-resistant component, wherein the electrically conductive component is at least one of copper and silver, and the arc-resistanc component is selected from the group consisting of Ti, Zr, V, Nb, Ta, Cr, Mo, W, carbides thereof and borides thereof and has a melting temperature of 1500° C. or more.

8. The electrode arrangement of claim 7, wherein the electrically conductive material of said pair of contact members further comprises at least one additive which is selected from Bi, Te, Pb and Sb.

9. The electrode arrangement of claim 1, wherein said pair of electrically conductive bars are aligned in said predetermined direction, each of said pair of contact members has a contacting surface at which contact of the contact members is made, and the contacting surface is perpendicular to said predetermined direction.

10. The electrode arrangement of claim 1, wherein the magnetic body comprises at least one pair of magnetic members, one of said magnetic members is arranged on one of said pair of contact members, and the other magnetic member is arranged on the other contact member.

11. The electrode arrangement of claim 10, wherein each of the magnetic members has a shape such that, when the magnetic member is magnetized by a circumferential magnetic field, open-loop magnetic fluxes along the magnetic field is created in the magnetic member.

12. The electrode arrangement of claim 11, wherein each of said pair of contact members has at least one electrically conductive pins connected to the contact member in parallel to said predetermined direction, and the circumferential magnetic field magnetizing the magnetic members is generated from the electrically conductive pins.

13. The electrode arrangement of claim 1, wherein the contact member, the electrically conductive bars and the magnetizing device are enclosed by a container so that an atmosphere in the container is maintained to vacuum by the container.

* * * * *